US012752968B1

(12) United States Patent
Shupe et al.

(10) Patent No.: US 12,752,968 B1
(45) Date of Patent: Oct. 6, 2026

(54) CONTAINER WITH UPPER AND LOWER FINGER GRIPS

(71) Applicants: Justin O. Shupe, Mattoon, IL (US); Seth K. White, Trilla, IL (US)

(72) Inventors: Justin O. Shupe, Mattoon, IL (US); Seth K. White, Trilla, IL (US)

(73) Assignee: Dual Force Buckets LLC, Mattoon, IL (US)

( * ) Notice: Subject to any disclaimer, the term of this patent is extended or adjusted under 35 U.S.C. 154(b) by 0 days.

(21) Appl. No.: 19/209,104

(22) Filed: May 15, 2025

(51) Int. Cl.
*B65D 25/30* (2006.01)
*B65D 25/32* (2006.01)

(52) U.S. Cl.
CPC ..... *B65D 25/30* (2013.01); *B65D 25/32* (2013.01)

(58) Field of Classification Search
CPC ..... B65D 25/2802; B65D 25/2805; B65D 25/2817; B65D 25/2829; B65D 25/2882; B65D 25/30; B65D 25/32
USPC ..... 220/600, 669, 752, 770, 771, 772, 675, 220/676
See application file for complete search history.

(56) References Cited

U.S. PATENT DOCUMENTS 6,808,081 B1 * 10/2004 Citro ..... B65F 1/16 116/63 P
8,360,265 B1 * 1/2013 Andrews ..... B65F 1/14 220/675
D683,920 S 6/2013 Bonafide
D683,921 S 6/2013 Bonafide
D684,327 S 6/2013 Bonafide
8,714,404 B2 * 5/2014 Raghunathan ..... B65F 1/1646 220/759
D726,385 S 4/2015 O'Leary et al.
D739,626 S 9/2015 Condiff
D743,136 S 11/2015 Condiff
D782,768 S 3/2017 Luburic
9,856,052 B2 1/2018 O'Leary et al.
10,131,467 B2 11/2018 Luburic
10,450,105 B2 10/2019 Luburic
10,730,666 B1 8/2020 Lee
D917,816 S 4/2021 Bonafide
11,096,377 B1 8/2021 Rogers
2003/0116577 A1 6/2003 Slongo et al.
2009/0084794 A1 * 4/2009 Vaiana ..... B65F 1/1468 220/772
2010/0077790 A1 * 4/2010 Apps ..... B65D 77/0486 62/372

(Continued)

FOREIGN PATENT DOCUMENTS

BR 202013010177 U2 * 11/2015 ..... B65D 25/32
CN 304480789 S 1/2018

(Continued)

*Primary Examiner* — Nathan J Jenness
*Assistant Examiner* — Madison L Poos
(74) *Attorney, Agent, or Firm* — Grace J. Fishel

(57) ABSTRACT

A container having a base and an upwardly extending sidewall with a lip aligned with the sidewall and extending below the base. An annular ring attached to the sidewall below a top edge of the sidewall. A vertical channel formed in the sidewall extending from a bottom edge of the lip upward above the annular ring. A lifting ring attached to the base inboard of the lip. An upper finger grip formed in a gap between the annular ring and the vertical channel and a lower finger grip formed in a gap between the thinned area of the lifting ring and the base.

9 Claims, 9 Drawing Sheets

(56) References Cited

U.S. PATENT DOCUMENTS

| | | | | |
|---|---|---|---|---|
| 2014/0361026 | A1* | 12/2014 | Carnesecca | B65D 1/16 220/771 |
| 2015/0321796 | A1* | 11/2015 | O'Leary | B65D 1/42 220/675 |
| 2015/0360818 | A1 | 12/2015 | Condiff | |
| 2016/0280423 | A1* | 9/2016 | Luburic | B65D 7/04 |

FOREIGN PATENT DOCUMENTS

| | | | | |
|---|---|---|---|---|
| CN | 307307078 | S | 5/2022 | |
| CN | 307621148 | S | 10/2022 | |
| CN | 308980785 | S | 12/2024 | |
| DE | 19924105 | A1 * | 11/2000 | B65F 1/122 |

* cited by examiner

CONTAINER WITH UPPER AND LOWER FINGER GRIPS

BACKGROUND OF THE INVENTION

Field of the Invention

The present invention relates to a container with a lifting ring with finger grips on the bottom and an annular ring with finger grips adjacent the top for more ergonomic raising of the container and controlled pouring.

Brief Description of the Prior Art

Conventional containers, such as the five-gallon buckets commonly used on construction sites, can be difficult to handle when filled with materials. These buckets often feature a wire handle to assist with lifting. However, when pouring from such a container, the user typically must grip the wire handle with one hand and support the bottom of the bucket with the other. Unfortunately, conventional buckets lack an ergonomic way to securely grip the bottom, making this task awkward and potentially unsafe.

Some containers attempt to address this issue by incorporating handles molded into the sidewall. However, these molded handles protrude into the interior of the bucket, interfering with tools such as mixers and complicating the mixing process. The protrusion also hinders the clean emptying of viscous materials, like caulk. Additionally, because a sidewall handle positions the user's hand off-center, it makes controlled pouring more difficult from an ergonomic standpoint.

As a result, there remains a need for an improved container design that offers better ergonomics and usability.

BRIEF SUMMARY OF THE INVENTION

In view of the above, it is an object of the present invention to provide a container with upper and lower finger grips for ergonomic carrying and raising of the container and for controlled pouring.

BRIEF DESCRIPTION OF THE SEVERAL VIEWS OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
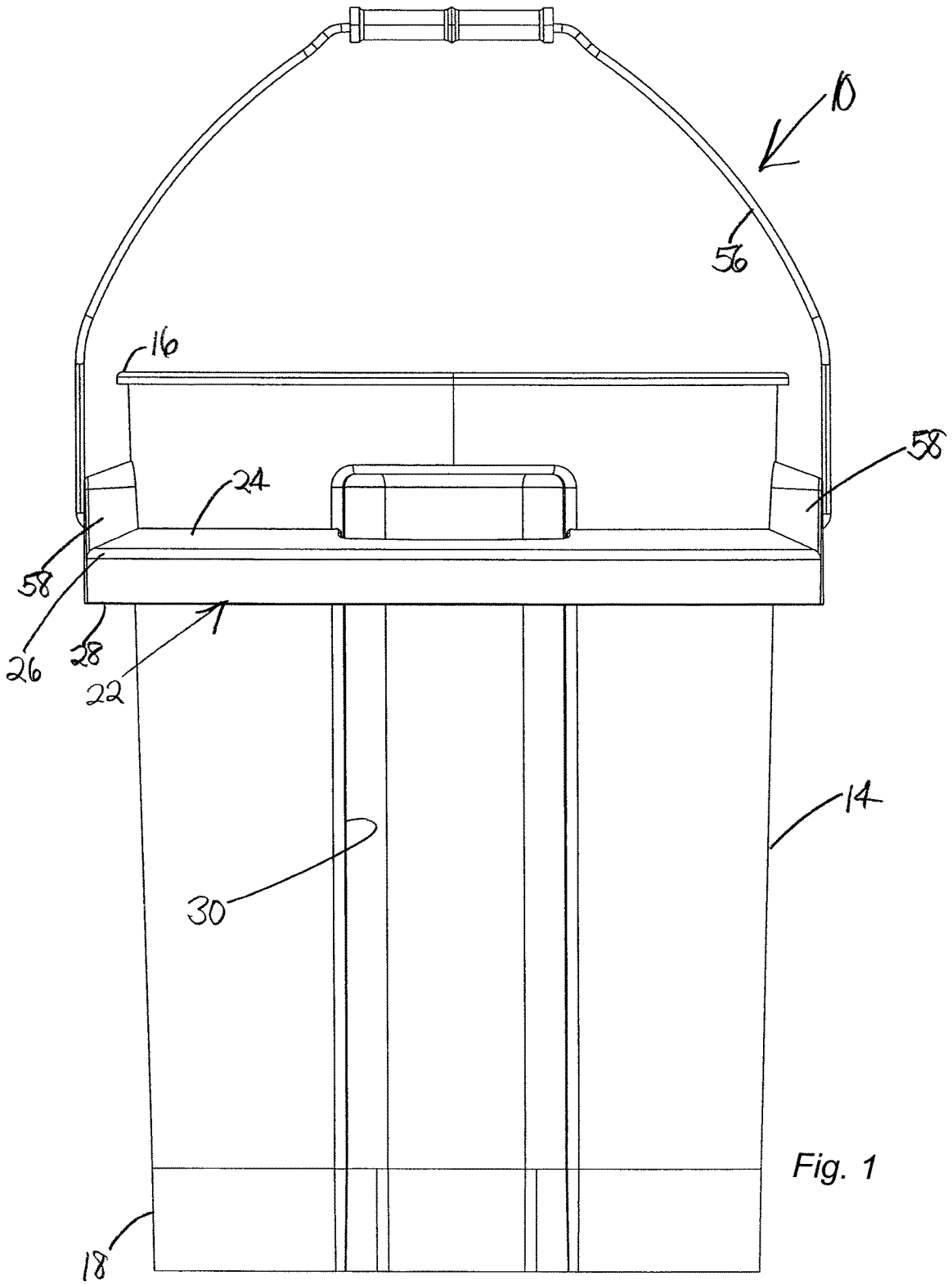
FIG. 1 is a front elevation of a Container in accordance with the present invention, the back elevation being identical.
Figure 2:
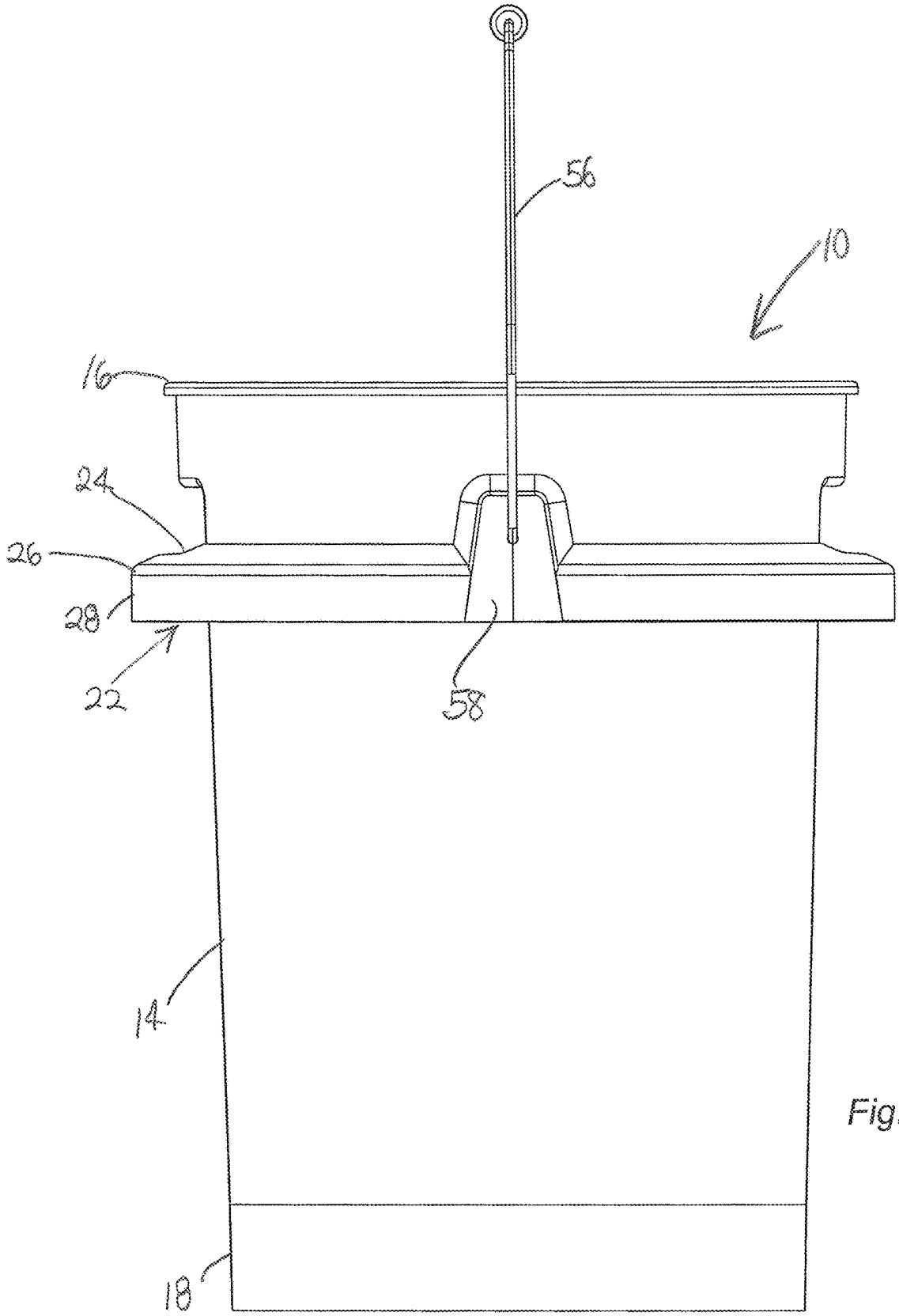
FIG. 2 is a right side elevation thereof, the left side elevation being identical.
Figure 3:
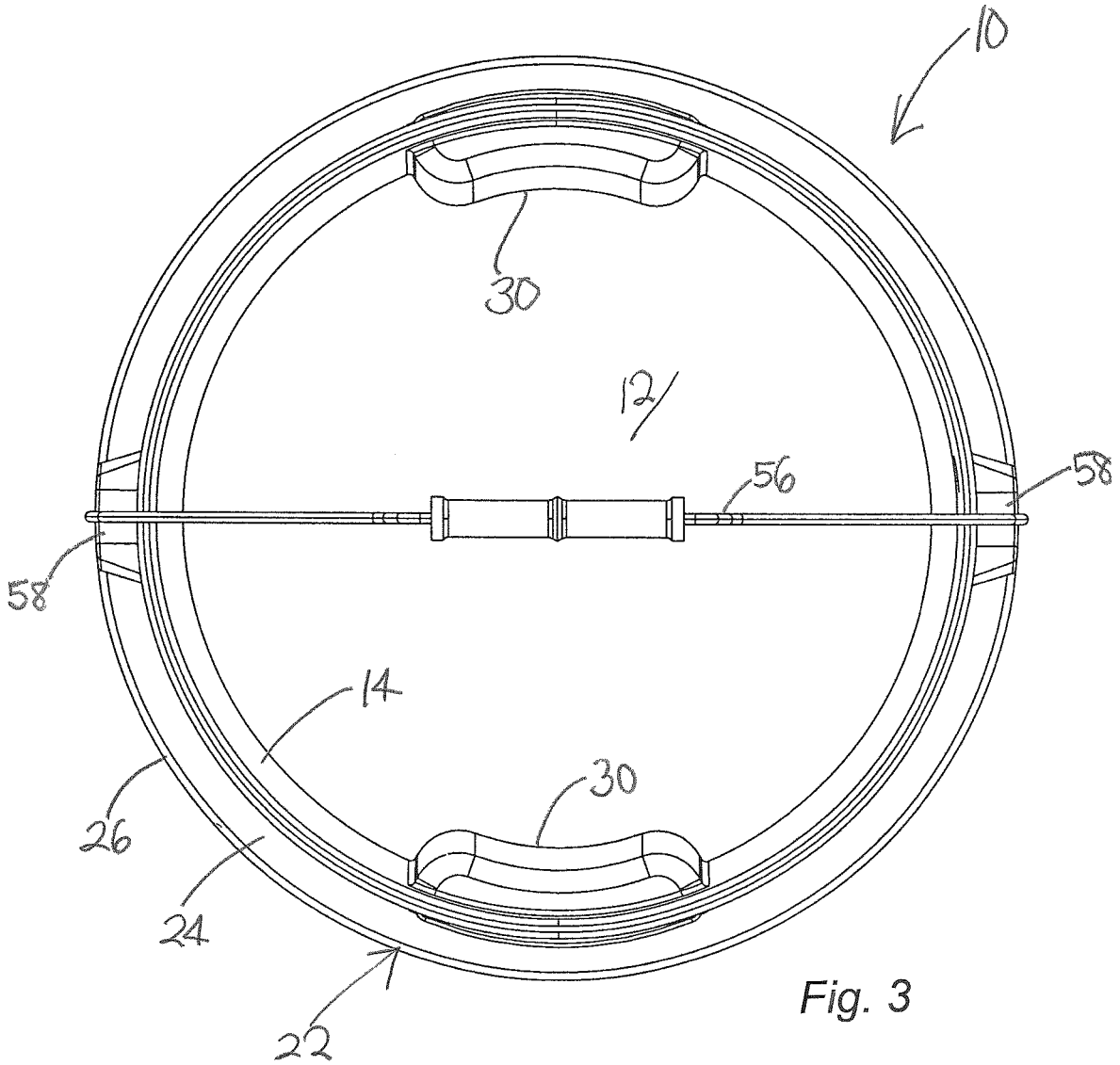
FIG. 3 is a top view thereof.
Figure 4:
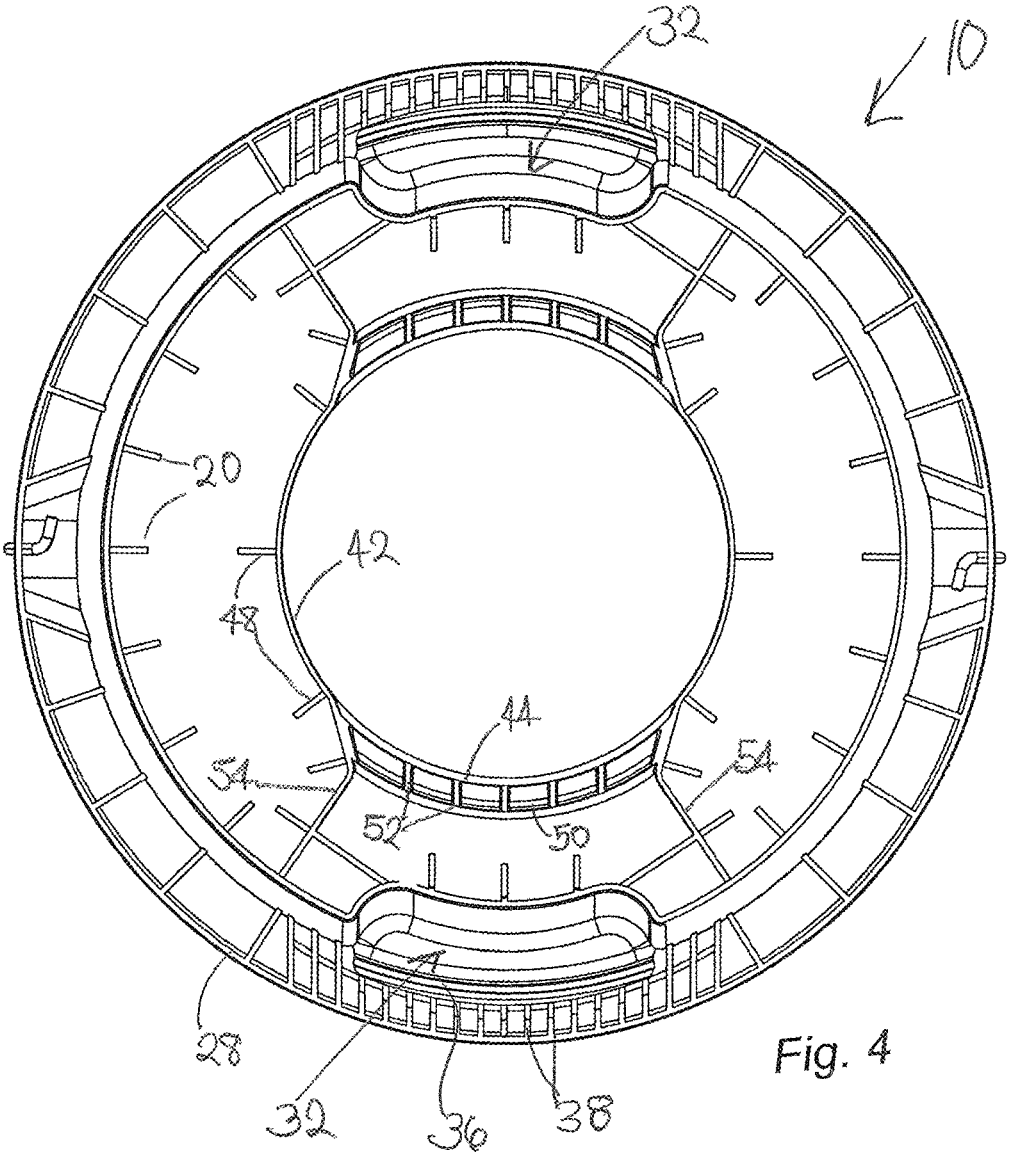
FIG. 4 is a bottom view thereof.
Figure 5:
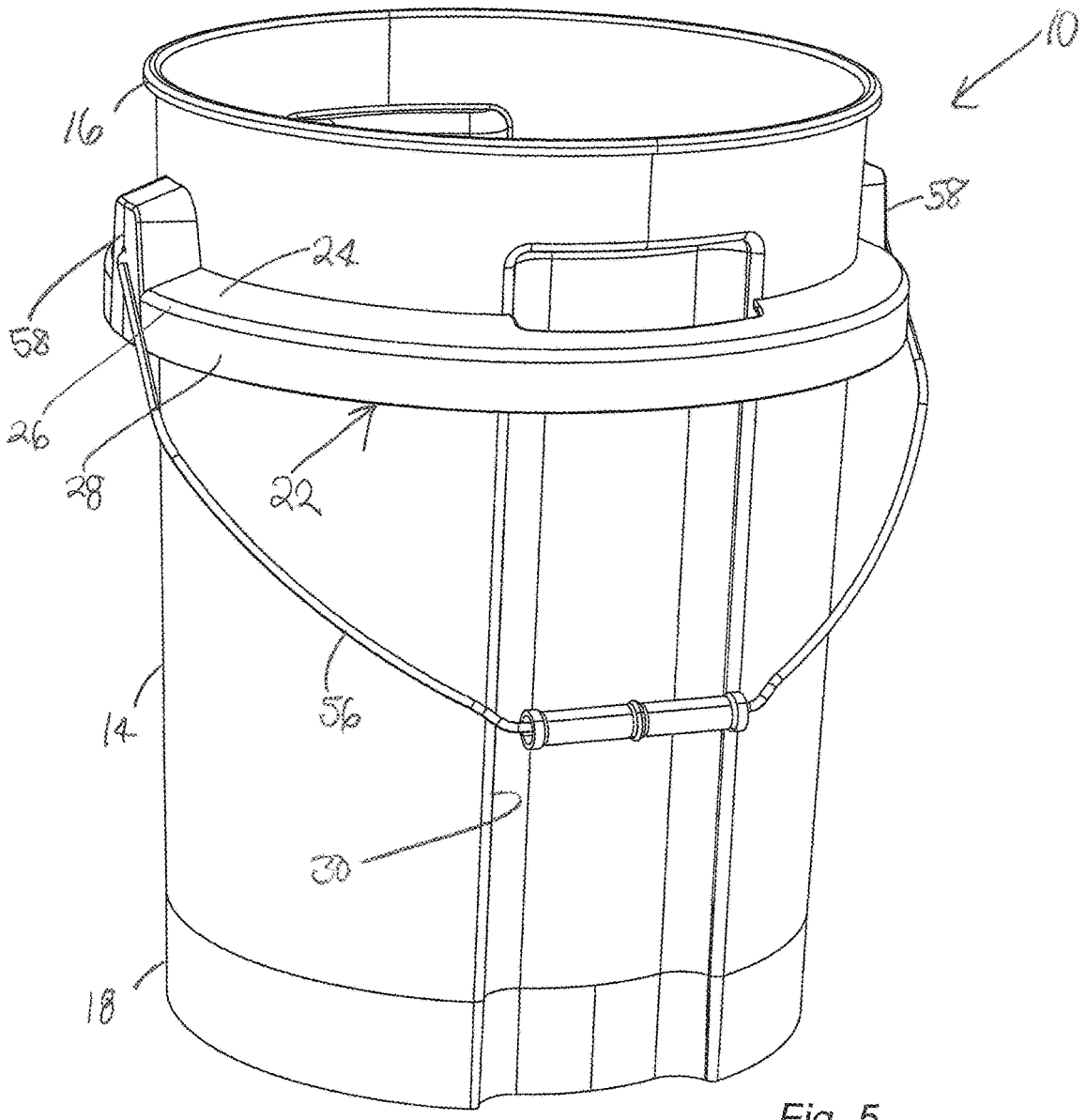
FIG. 5 is a perspective view thereof seen from above.
Figure 6:
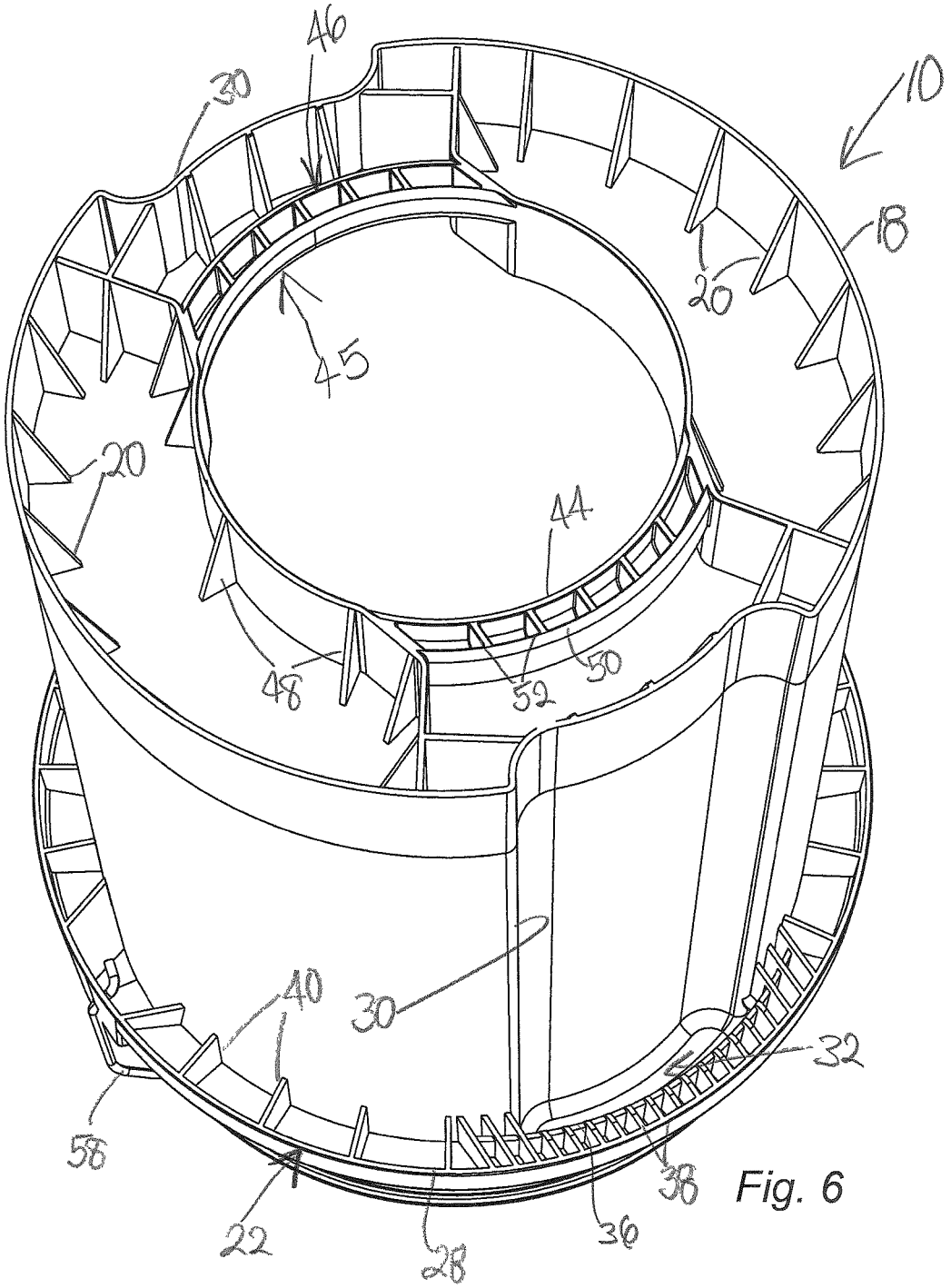
FIG. 6 is first perspective view thereof seen from below.
Figure 7:
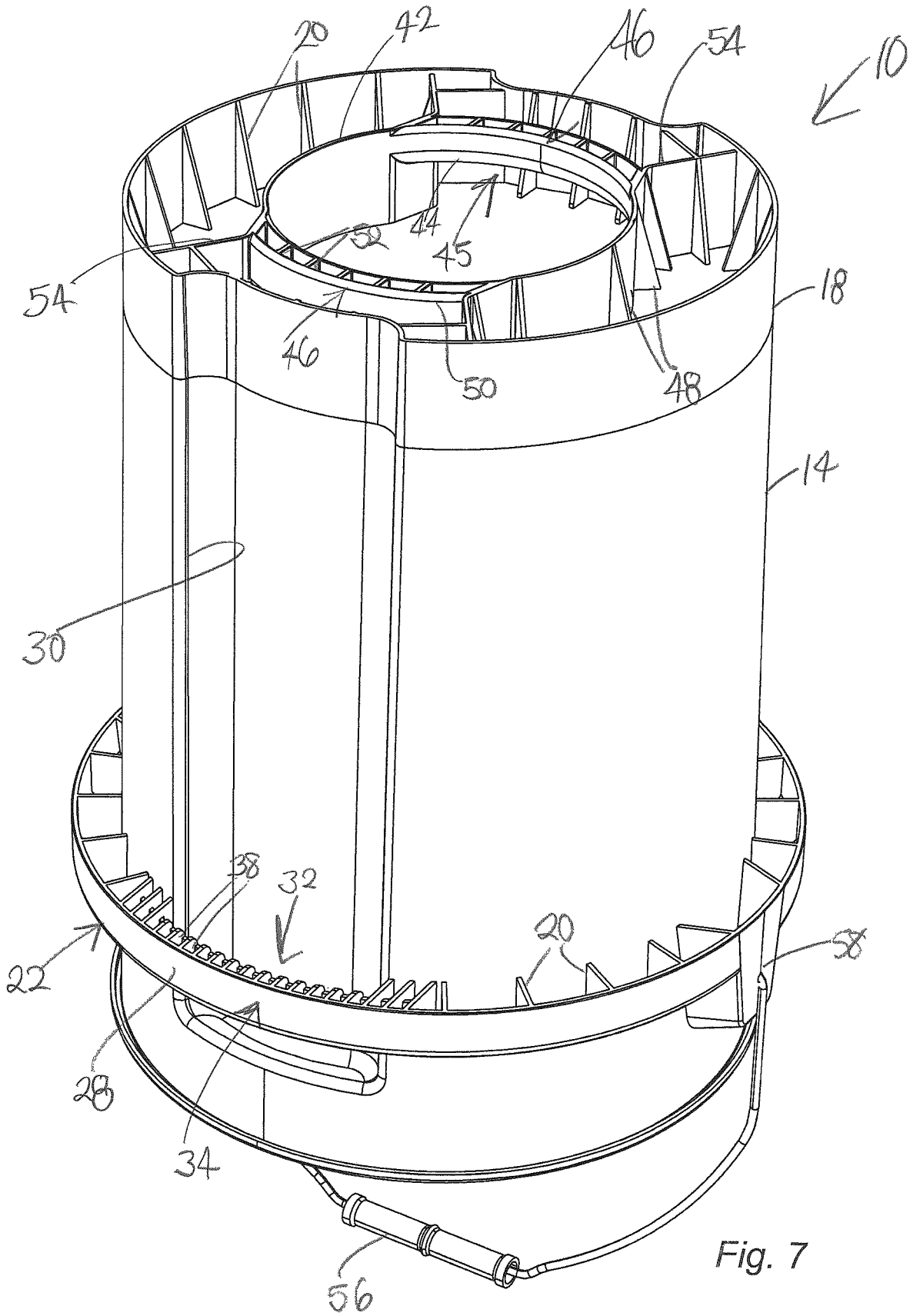
FIG. 7 is a second perspective view in a different position seen from below.

Referring to the accompanying drawings, the present invention pertains to a container, generally designated by reference numeral 10, designed for the storage and transport of materials.

In the depicted embodiment, container 10 comprises a substantially circular base 12 and an upwardly extending circumferential sidewall 14 with a slight outward taper. The upper edge of sidewall 14 includes a bead 16 configured to engage with a corresponding cover (not shown). Extending downward from base 12 is a lip 18 aligned with sidewall 14, reinforced with internal braces 20 to enhance structural support such that container 10 may sit upon the lip.

An annular ring 22, having a diameter exceeding that of the container, is affixed to the exterior surface of the sidewall 14 below the top edge. This annular ring 22 comprises a generally flat ledge 24 attached to sidewall 12, an eased shoulder 26 and a depending skirt 28. At least one vertical channel 30 is formed in sidewall 14 extending from a bottom edge of lip 18 upward above annular ring 22. Vertical channel 30 is dimensioned to accommodate a user's hand.

A gap 32 between annular ring 22 and vertical channel 30 provides an upper finger grip 34. When two diametrically opposed vertical channels 30 are present, corresponding upper finger grips 34 are formed on opposite sides of annular ring 22. Within gap 32, an inner depending skirt 36 is attached to flat ledge 24, rendering annular ring 22 U-shaped in cross-section across gap 32. Radial braces 38 connect inner and outer skirts 28, 36, providing structural reinforcement to finger grip 34. Eased shoulder 26 in conjunction with skirts 28, 36 and flat ledge 24, offers an ergonomically contoured handle for user comfort. Additional radial braces 40 between outer depending skirt 28 and sidewall 14 further reinforce annular ring 22.

A lifting ring 42 is affixed to the underside of base 12 within lip 18. This lifting ring 42 features a thinned area 44 not attached to base 12, aligned with vertical channel 30, thereby forming a lower finger grip 46. In the illustrated embodiment, lifting ring 42 is a circular band supported by external braces 48. At thinned area 44, the band is backed by an outer curved band 50, with radial braces 52 between the bands forming a reinforced assembly for lower finger grip 46. Spokes 54 between lifting ring 42 and lip 18 provide torsional and lateral support to the band.

Container 10 may optionally include a carrying handle, such as a bale 56. For this purpose, bale blocks 58 may be integrally molded with annular ring 22. When present, bale blocks 58 are positioned between vertical channels 30 on opposite sides of the container 20 to ensure balanced lifting. Bale 56 engages with bale blocks 58 and pivots about its attachment point, facilitating lifting and pouring of the container in a conventional manner. Bale blocks 58 may be hollow to permit stacking of multiple containers 10.

The embodiment depicted in the drawings represents a five-gallon bucket incorporating bale 56, upper finger grips 34 and lower finger grip 46. However, various combinations of these features fall within the scope of the invention. The container 10 may vary in size or shape and may or may not include a bale or a lid. Additionally, container 10 may include only upper finger grips 34 or lower finger grips, rather than both. The container may be integrally molded or assembled from separately formed components.

Figure 8:
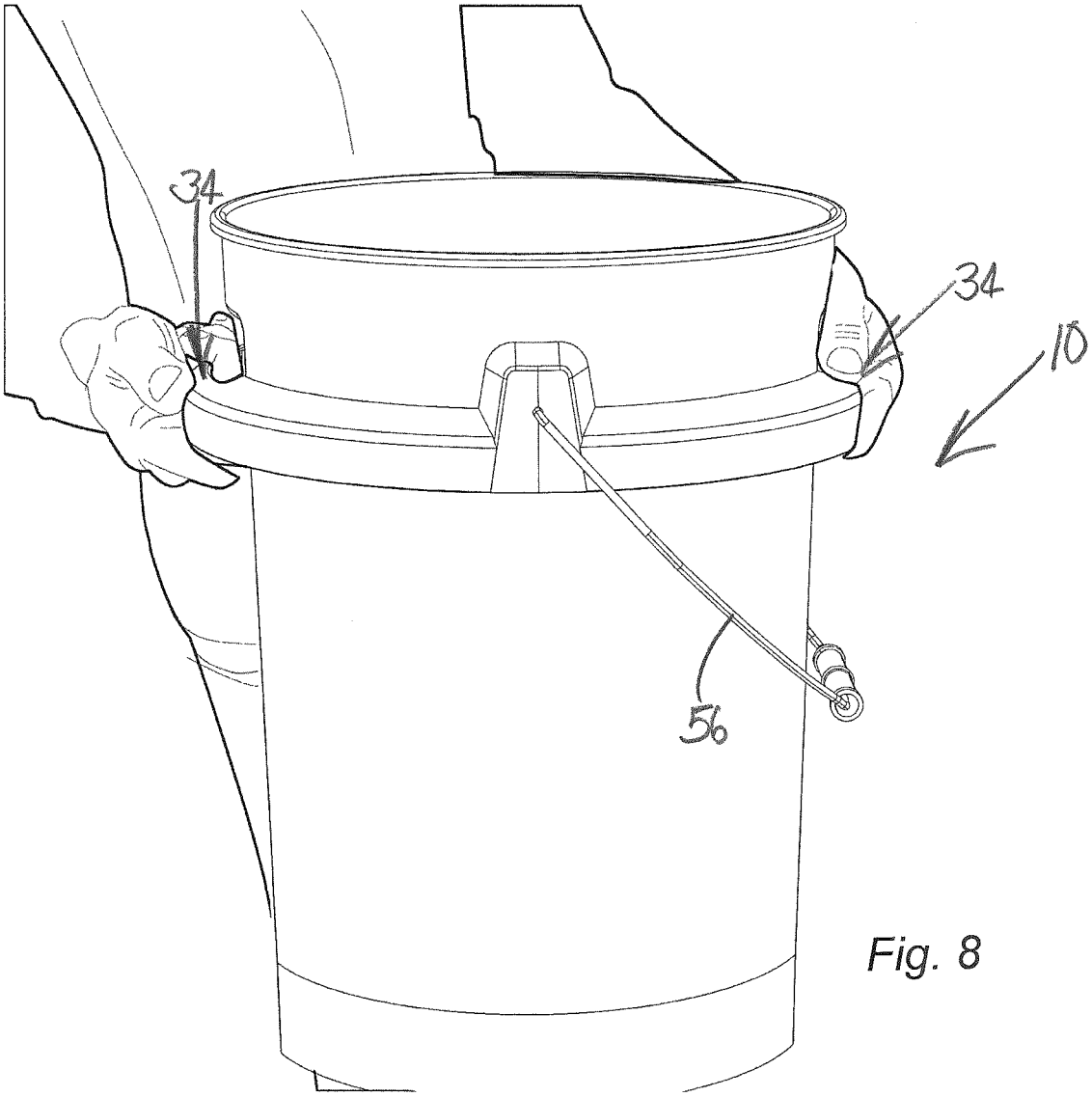
FIG. 8 is a view showing the container being carried by a user with upper finger grips; and, FIG. 9 is a view showing the container being ergonomically lifted and its contents poured by a user using upper and lower finger grips working in concert.
Figure 9:
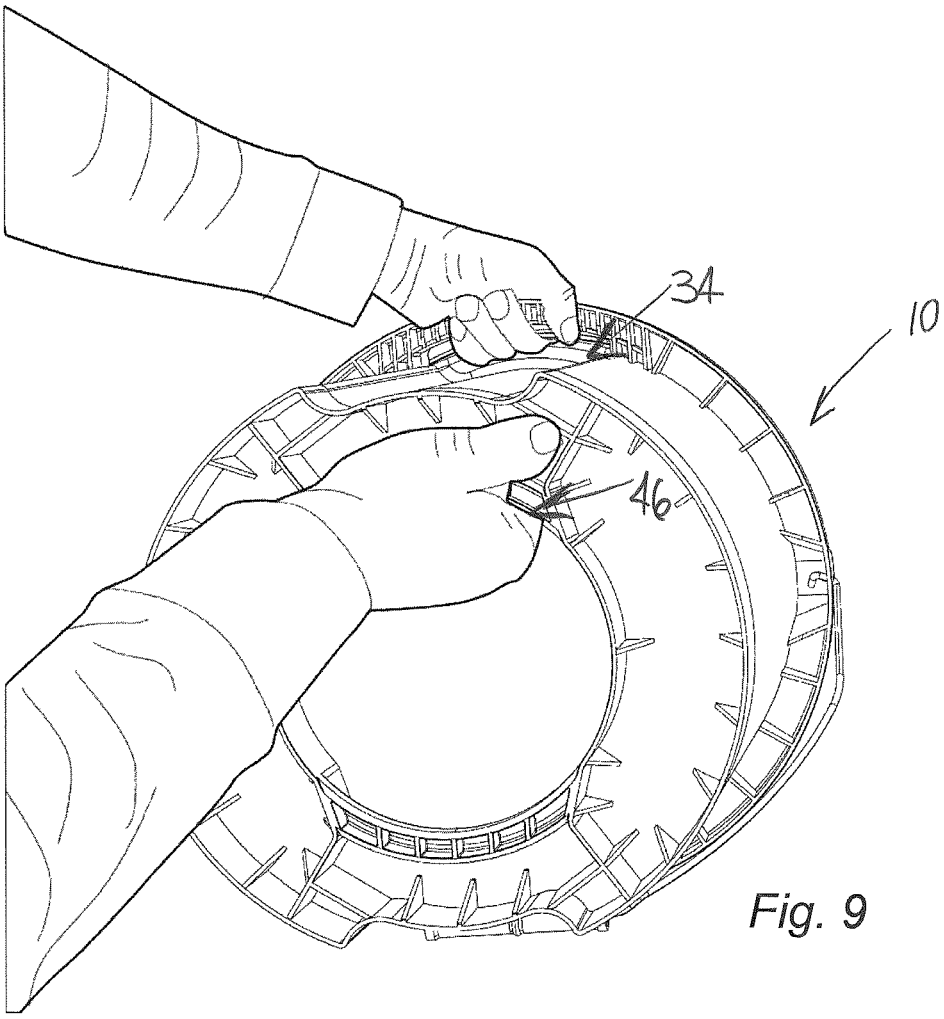

In use, as illustrated in FIG. 8, upper finger grips 34 enable secure carrying of the container 10 with two hands (or people). This reduces the risk or spills and splashes, especially with liquids or fine materials. The combination of upper and lower finger grips 34, 46 allows ergonomic stabilization during pouring, as shown in FIG. 9. During pouring, the user's lower hand bears the majority of the container's weight, and because the lower finger grip 46 is closer to the container's center of gravity than a traditional rim grip, it allows improved control. Likewise, upper finger grip 34 offers enhanced directional control. When container 10 is lifted to pour into a tank or high container, bottom finger grip 46 provides leverage and control during the lift and tilt motion.

Vertical channels 30 are configured such that they do not interfere with pouring or mixing the container's contents and containers 10 may be stacked for shipping or storage with their vertical channels 30 in alignment.

In view of the above, it will be seen that the object of the invention is achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A container comprising a base and a circumferential sidewall, a continuous lip aligned with the sidewall and extending below the base;

an annular ring adjacent a top end of the sidewall;

first and second diametrically opposed vertical channels formed in the sidewall starting at a bottom edge of the lip and extending under and above the annular ring;

an upper finger grip formed in a first gap between the annular ring and the vertical channel and configured such that a user's fingers on a first hand can slide through and fit around the annular ring for lifting; and, a lifting ring attached to the base inside of the lip and spaced apart from the lip such that the lifting ring lies inward toward the container's center of gravity, said lifting ring having a thinned area providing a second gap between the lifting ring and the base aligned with each of the vertical channels forming a lower finger grip configured such that a user's fingers on a second hand can slide through and fit around the lifting ring for lifting.

2. The container of claim 1 wherein the lifting ring comprises a circular band, an outer curved band segment aligned with each of the vertical channels disposed concentrically around and spaced outwardly of the thinned area of the circular band, and a plurality of radial braces connecting the circular band to the outer curved band segment.

3. The container of claim 2 wherein spokes are provided between the lifting ring and the lip for tensional and lateral stability of the circular band segment in each of the vertical channels.

4. The container of claim 1 wherein the lip is reinforced with braces between the lip and the base to enhance structural support of the container.

5. A container comprising a base and a circumferential sidewall with an outward taper, a continuous lip aligned with the sidewall and extending below the base;

an upper edge of the sidewall having a bead configured to engage with a corresponding cover, an annular ring adjacent a top end of the sidewall;

first and second diametrically opposed vertical channels formed in the sidewall starting at a bottom edge of the lip and extending under and above the annular ring;

an upper finger grip formed in a first gap between the annular ring and the vertical channel and configured such that a user's fingers on a first hand can slide through and fit around the annular ring for lifting; said annular ring having bale blocks configured to attach a wire handle positioned between the first and second diametrically opposed vertical channels, said bale blocks having an aperture for receipt of the wire handle; and, a lifting ring attached to the base inside of the lip and spaced apart from the lip such that the lifting ring lies inward, toward the container's center of gravity, said lifting ring having a thinned area with a second gap between the lifting ring and the base aligned with the vertical channels forming a lower finger grip configured such that a user's fingers on a second hand can slide through and fit around the lifting ring for lifting.

6. The container of claim 5 wherein the annular ring includes a generally flat top ledge attached to the sidewall, an eased shoulder and an outer depending skirt.

7. The container of claim 6 wherein an inner depending skirt is attached to the ledge in the first gap between the annular ring and each of the vertical channels.

8. The container of claim 7 wherein radial braces are provided between the outer depending skirt and the inner depending skirt in the first gap.

9. The container of claim 8 wherein braces are provided between the outer depending skirt and the sidewall outside the first gap.

* * * * *